United States Patent [19]

Washington et al.

[11] Patent Number: 4,511,822

[45] Date of Patent: Apr. 16, 1985

[54] IMAGE DISPLAY TUBE HAVING A CHANNEL PLATE ELECTRON MULTIPLIER

[75] Inventors: Derek Washington, Wallington; Roger Pook, East Grinstead, both of England

[73] Assignee: U.S. Philips Corporation, New York, N.Y.

[21] Appl. No.: 326,867

[22] Filed: Dec. 3, 1981

[30] Foreign Application Priority Data

Dec. 19, 1980 [GB] United Kingdom ..... 8040798

[51] Int. Cl.[3] ..... H01J 31/48; H01J 43/28

[52] U.S. Cl. ..... 313/400; 313/105 CM; 313/106

[58] Field of Search ..... 313/400, 379, 387, 103 CM, 313/105 CM, 106

[56] References Cited

U.S. PATENT DOCUMENTS 3,860,849 1/1975 Schagen et al. ..... 313/400
4,023,063 5/1977 King et al. ..... 313/400
4,023,064 5/1977 Schagen et al. ..... 313/400
4,034,254 7/1977 King et al. ..... 313/400
4,079,286 3/1978 Popp ..... 313/106 X
4,422,005 12/1983 Washington et al. ..... 313/105 CM

*Primary Examiner*—David K. Moore
*Assistant Examiner*—K. Wieder
*Attorney, Agent, or Firm*—Robert J. Kraus

[57] ABSTRACT

The image contrast in an image display tube having a channel plate electron multiplier (2) is improved by preventing secondary electrons emitted from the face of an input dynode (26) from straying to channels located at a relatively large distance from their origin. This is done by disposing a grid (24) at a short distance from the input dynode (26). If the grid (24) is held at a positive voltage relative to the input dynode (26), stray secondary electrons will be attracted toward the grid (24). Alternatively, if the grid (24) is held at a negative voltage relative to that of the input dynode (26), the secondary electrons will be induced to enter channels close to their origin.

6 Claims, 2 Drawing Figures

IMAGE DISPLAY TUBE HAVING A CHANNEL PLATE ELECTRON MULTIPLIER

BACKGROUND OF THE INVENTION

The present invention relates to an image display tube comprising an envelope having a faceplate, a phosphor screen on or adjacent to the inner surface of the faceplate, means for generating a beam of electrons, a channel plate electron multiplier disposed adjacent to, but spaced from the phosphor screen, the electron multiplier comprising a plurality of discrete apertured dynodes arranged as a stack with the apertures in each dynode aligned with apertures in an adjacent dynode to provide channels, the apertures in the input dynode diverging in the direction of the incoming beam of electrons, and the maximum cross-sectional area of the apertures in the dynodes being substantially the same.

Electron multipliers have been proposed for image display tubes for example in British Patent Specification No. 1,434,053. In an image display tube a low energy electron beam produced for example by an electron gun is scanned across the input side of a large area channel plate electron multiplier which is disposed at a short distance from a phosphor screen provided on the inner surface of a substantially parallel faceplate. The electron beam undergoes amplification by current multiplication in the electron multiplier before being incident on the phosphor screen.

The channel plate electron multiplier comprises a stack of dynodes insulated from each other. Apertures in adjacent dynodes are aligned with each other to define channels. In use a substantially constant potential difference exists between adjacent dynodes. When a beam of electrons is incident on the input side of the channel plate electron multiplier, secondary electrons are produced of which the majority enter the channels and are multiplied so that an image is produced on the phosphor screen. Because the output is an image it is important to ensure that it is spatially correct to avoid distortions. Also it is desirable that the image should have good contrast and good brightness.

As approximately 24% of the area of a discrete dynode is occupied by apertures then it is inevitable that as an electron beam is scanned say in raster-like fashion across the input or first dynode that it will impinge on the dynode material between the apertures and produce secondary electrons. Some of these secondary electrons may enter a nearby channel but others may stray a relatively large distance across the input surface of the first dynode before entering a channel. Hence the image is degraded spatially and there is a corresponding reduction in contrast. If the cross-sectional area of each aperture is enlarged then this will lead to the overall structure being less rigid and therefore subject to the effects of vibration or, alternatively, if the number of enlarged cross-section channels is reduced to stiffen the dynodes then this is of no advantage in mitigating the problem of stray secondaries because the ratio of the area of the apertures to the area of the material between the apertures is returned towards that of the originally postulated situation. Furthermore channels of larger cross-sectional area will increase the possibility of incoming electrons passing through a channel without undergoing multiplication.

It has also been proposed to reduce the number of secondary electrons produced from the materials between the apertures by covering the material with a low secondary emitting material, such as carbon, having a secondary electron emission coefficient less than 2.0. While this improves the contrast it does not completely preclude the production of secondary electrons which may stray a relatively large distance before entering a channel.

SUMMARY OF THE INVENTION

Accordingly it is an object of the present invention to reduce the number of secondary electrons which can stray a relatively large distance before entering a channel in an image display tube.

According to the present invention there is provided an image display tube comprising an envelope having a faceplate, a phosphor screen on or adjacent to the inner surface of the faceplate, means for generating a beam of electrons, a channel plate electron multiplier disposed adjacent to, but spaced from, the phosphor screen, the electron multiplier comprising a plurality of discrete apertured dynodes arranged as a stack with the apertures in each dynode aligned with apertures in an adjacent dynode to provide channels, the apertures in the input dynode diverging in the direction of the incoming beam of electrons, and the maximum cross-sectional area of the apertures in the dynodes being substantially the same, characterized in that a grid is disposed adjacent to, but spaced from, the input dynode, the grid in use being held at a potential such that the risk of stray secondary electrons from the input dynode entering channels remote from the origin is reduced or prevented.

The grid may be operated in one of two ways. In a first way a non-retarding field is produced on the side of the grid remote from the electron multiplier and the grid is held at a positive voltage relative to the input dynode so that any stray electrons are attracted to and through the grid. In a second way the grid is held at a negative voltage relative to that of the input dynode and the field produced induces secondary electrons to enter channels close to their origin and thereby contribute to the brightness of the image. Either way the contrast is improved by the correct maintenance of the spatial integrity of the image.

If desired the number of secondary electrons produced from the material between the apertures can be reduced by disposing a material, such as carbon, having a secondary electron emission coefficient on the outermost surface of the input dynode between the apertures therein.

BRIEF DESCRIPTION OF THE DRAWING

The present invention will now be explained and described, by way of example, with reference to the accompanying drawing, wherein.

DESCRIPTION OF THE PREFERRED EMBODIMENTS

Figure 1:
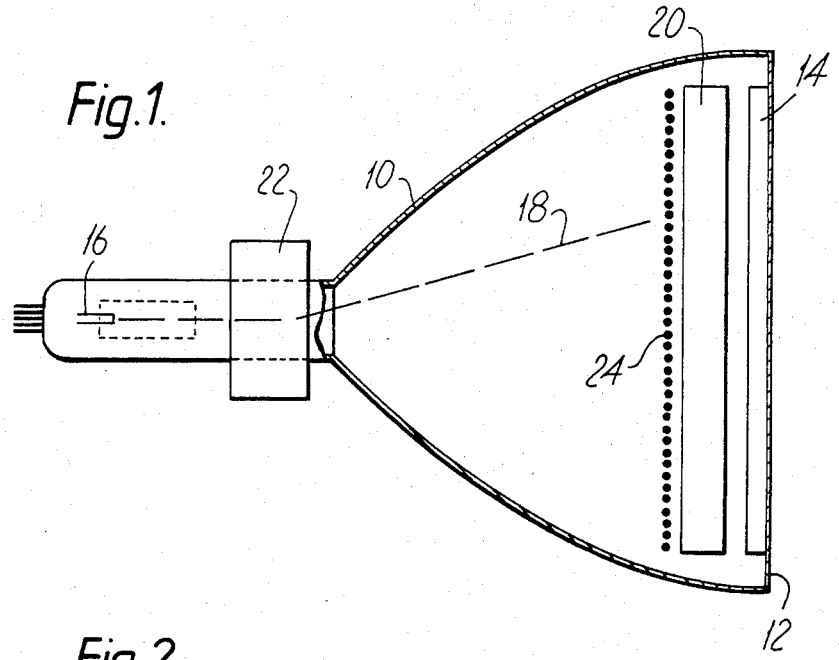
FIG. 1 is a diagrammatic cross-sectional view of an image display tube made in accordance with the present invention.

Referring initially to FIG. 1, the image display tube comprises an envelope 10 having a faceplate 12 on which a phosphor screen 14 is disposed. Means 16, such as an electron gun, for generating an electron beam 18 is disposed in the envelope 10 at a position remote from the faceplate 12. A channel plate electron multiplier 20 is disposed adjacent to, but spaced from, the phosphor screen 14. Deflection coils 22 are provided in order to deflect the electron beam 18 in raster fashion across the input side of the electron multiplier 20. Those electrons entering the channel undergo electron multiplication so that at the output side of the electron multiplier a high current beam is produced which impinges on the phosphor screen 14.

The image as viewed should not only be spatially correct in order to display the input spatial information properly but also should be of good contrast. It has been realised that the contrast can be degraded by secondary electrons produced on the input side of the electron multiplier 20 straying and entering channels remote from their origin. In order to overcome this problem of stray secondary electrons a grid 24 is disposed adjacent to, but spaced from, the input side of the electron multiplier 20; the space being between 5 and 10 mm. The operation of the grid 24 will be described with reference to FIG. 2.

Figure 2:
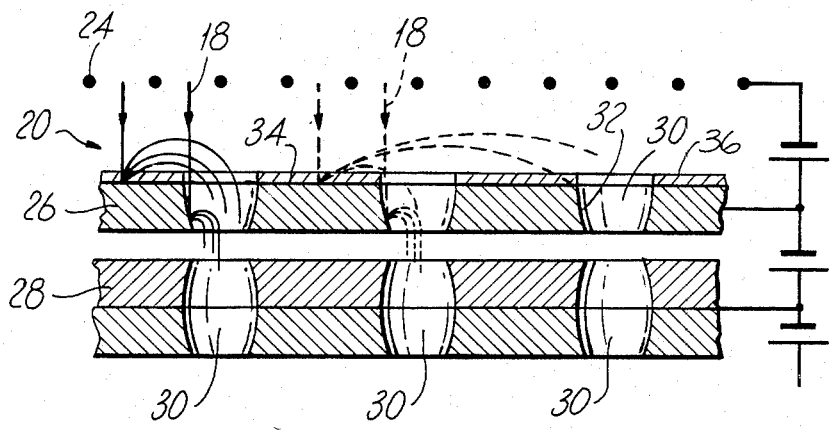
FIG. 2 is a diagrammatic cross-sectional view of a grid and the first and second dynodes of a channel plate electron multiplier.

The channel plate electron multiplier shown in FIG. 2 is itself of a type disclosed fully in British Patent Specification No. 1,434,053 details of which are incorporated herein by way of reference. Insofar as the understanding of the present invention is concerned it is sufficient to point out that the channel plate electron multiplier 20 comprises a stack of apertured dynodes, say ten dynodes, of which the first two 26 and 28 are shown. The dynodes are separated by spacers (not shown). In use a different voltage is applied to each dynode so that the output dynode (not shown) is at a high positive voltage relative to the input of the first dynode 26.

The apertures 30 in the dynodes are aligned to form the channels. Apart from the first dynode 26, the apertures 30 are of barrel shape when viewed in longitudinal cross-section. Conveniently apertures of such a shape are formed by etching a plurality of cup-shaped or divergent apertures in sheets of metal and then placing the sheets together so that the surfaces having apertures of the largest cross-section therein are placed face to face. However, the input or first dynode 26, comprises a single sheet arranged with its apertures diverging towards the direction of incoming electrons. The maximum cross-sectional area of the apertures in all the dynodes is substantially the same and approximately 25% of the area of each dynode comprises the apertures 30.

The metal sheets forming the dynodes may comprise mild steel of which the inside of the apertures 30 is provided with a coating of a secondary emissive material or a material such as a silver-magnesium alloy or a copper-beryllium alloy which is subsequently activated to produce a secondary emitting surface.

Ignoring the grid 24 for the moment, an electron beam 18 shown in broken lines is scanned across the input side of the first dynode 26. Secondary electrons are produced by the incoming electron beam impinging on a multiplying surface 32 of each aperture 30 as well as on the outermost surface 34 between the apertures. Generally a majority of the secondary electrons produced from the multiplying surfaces 32 enter the apertures 30 together with some secondary electrons produced from the surface 34. However as illustrated other secondary electrons stray and enter channels remote from their origins. This will lead to spatial inaccuracies with a corresponding loss of contrast in the image as viewed on the screen 14.

The problem of the production of secondary electrons from the surface 34 can be reduced by disposing a material 36, such as carbon, having a secondary electron emission coefficient of less than 2 on the surface 34 either as a film evacuated thereon or as a separate layer. In either case the apertures 30 are left open.

Although such a measure will reduce the number of stray secondary electrons, it will not eliminate them.

This problem can be mitigated using the grid 24. If the potential applied to the grid 24 is made positive relative to the potential of the first dynode 26 by between 1 to 2 volts and up to 100 volts and it is ensured that a retarding field does not exist beyond the grid 24 on the electron beam generating means 16 side then the field produced by the grid 24 will attract stray electrons towards and through the grid 24 so that they do not return to the channel plate electron multiplier 20. One way of ensuring that a non-retarding field can be achieved is by applying a conductive coating on the wall of the envelope 10 on the side of the grid 24 remote from the electron multiplier 20 and applying a positive bias to it.

Alternatively, as illustrated in full lines, the potential applied to the grid 24 is made a few tens of volts to a few hundreds of volts negative relative to the potential of the first dynode 26; the maximum negative voltage being related to the beam energy, for example if the grid 24 is too negative then the beam will not land on the input side of the first dynode 26. The field produced causes stray electrons to be turned back towards the input face so that they do not travel far from their point of origin. In this latter case not only is the contrast improved but the overall brightness of the image on the phosphor screen 14 (FIG. 1) will be greater because more electrons will be detected and subsequently amplified.

What is claimed is:

1. A display tube comprising an envelope having a faceplate and containing a screen parallel to an inner surface of the faceplate, an electron beam producing means for directing an electron beam at the screen, and a channel plate electron multiplier spaced from the screen and having an input side facing the electron beam producing means and an output side facing the screen, said channel plate electron multiplier comprising a plurality of apertured dynodes having their apertures aligned to form electron multiplying channels, characterized in that the display tube further includes a grid, spaced from the input side of the channel plate electron multiplier, for producing an electric field which inhibits secondary electrons emitted from said input side, after impingement by the electron beam, from straying transversely to remote channels.

2. A display tube as in claim 1, including means for applying a potential to the grid which is positive with respect to the potential of the input side of the channel plate electron multiplier, thereby establishing an electric field which attracts straying secondary electrons away from the channel plate electron multiplier, and further including means for establishing on the side of the grid remote from the channel plate electron multiplier a non-retarding electric field which facilitates passage of attracted electrons through the grid.

3. A display tube as in claim 2, where the potential applied to the grid lies in the range 1–100 volts.

4. A display tube as in claim 1, including means for applying a potential to the grid which is negative with respect to the potential of the input side of the channel plate electron multiplier, thereby establishing an electric field which repels straying secondary electrons into channels near points where they were emitted from the input side of the channel plate electron multiplier.

5. A display tube as in claim 4, where the potential applied to the grid lies in the range of a few tens to a few hundreds of volts.

6. A display tube as in claim 1, 2 or 4, including a layer of material, having a secondary electron emission coefficient less than two, disposed on the input side of the channel plate electron multiplier.

* * * * *